10/20/87 XR 4,700,863

United States Patent [19]

Filippi et al.

[11] Patent Number: 4,700,863

[45] Date of Patent: Oct. 20, 1987

[54] SEAL WELDED CAST IRON NUCLEAR WASTE CONTAINER

[75] Inventors: Arthur M. Filippi, Pittsburgh; Richard P. Sprecace, Murrysville, both of Pa.

[73] Assignee: The United States of America as represented by the United States Department of Energy, Washington, D.C.

[21] Appl. No.: 910,241

[22] Filed: Sep. 16, 1986

Related U.S. Application Data

[63] Continuation of Ser. No. 569,070, Jan. 9, 1986, abandoned.

[51] Int. Cl.[4] ..... B65D 8/22

[52] U.S. Cl. ..... 220/67; 148/426; 220/75; 228/193; 228/196; 228/263.13; 228/263.14; 250/506.1; 403/271; 428/679

[58] Field of Search ..... 220/3, 89, 75, 66, 67; 250/506.1; 403/270, 271, 272; 285/329, 286, 916; 428/679; 148/426; 228/263.13, 253.14, 263.16, 193, 195, 196

[56] References Cited

U.S. PATENT DOCUMENTS

| | | | |
|---|---|---|---|
| 2,321,201 | 6/1943 | Heilman | 228/196 X |
| 2,500,119 | 3/1950 | Cooper . | |
| 2,568,013 | 9/1951 | Lee et al. . | |
| 2,963,129 | 12/1960 | Eberle . | |
| 3,136,050 | 6/1964 | Trueb et al. . | |
| 3,196,537 | 7/1965 | Groman et al. . | |
| 3,458,224 | 7/1969 | Freese . | |
| 3,555,667 | 1/1971 | Carlson et al. . | |
| 3,766,633 | 10/1973 | Lehrhener et al. | 228/193 X |
| 3,828,197 | 8/1974 | Boldt . | |
| 3,838,289 | 9/1974 | White . | |
| 4,026,583 | 5/1977 | Gottlieb | 228/193 X |
| 4,141,484 | 2/1979 | Hamilton et al. | 228/193 X |
| 4,172,547 | 10/1979 | DelGrande . | |
| 4,192,433 | 3/1980 | Hascoe . | |
| 4,209,123 | 6/1980 | Jay . | |
| 4,211,589 | 7/1980 | Fisher et al. . | |
| 4,274,007 | 6/1981 | Baatz et al. . | |
| 4,278,892 | 7/1981 | Baatz et al. . | |
| 4,333,671 | 6/1982 | Holko . | |

FOREIGN PATENT DOCUMENTS

| | | |
|---|---|---|
| 1187632 | 5/1985 | Canada . |
| 1189203 | 6/1985 | Canada . |
| 82467 | 6/1983 | European Pat. Off. . |
| 92698 | 11/1983 | European Pat. Off. . |
| 92679 | 11/1983 | European Pat. Off. . |
| 2024694 | 1/1980 | United Kingdom . |
| 2032329 | 5/1980 | United Kingdom . |

OTHER PUBLICATIONS

*Metals Handbook,* Ninth Ed., vol. 3, "Properties and Selection: Stainless Steels, Tool Materials and Special Purpose Metals", ASM (1980), p. 210.

*Metals Handbook,* Ninth Ed., vol. 1, "Properties and Selection: Irons and Steels", ASM (1978), pp. 3–8 and 377–402.

*Metals Handbook,* 8th Ed., vol. 7, "Atlas of Microstructures of Industrial Alloys", ASM (1972), pp. 69–100.

*Metals Handbook,* vol. 6, "Welding and Brazing", ASM (1971), pp. 235–244.

Huntington Alloys Handbook, published by the International Nickel Co., Inc. (1970), pp. 5, 24, 35.

*Primary Examiner*—Allan N. Shoap

*Attorney, Agent, or Firm*—R. A. Stoltz

[57] ABSTRACT

This invention identifies methods and articles designed to circumvent metallurgical problems associated with hermetically closing an all cast iron nuclear waste package by welding. It involves welding nickel-carbon alloy inserts which are bonded to the mating plug and main body components of the package. The welding inserts might be bonded in place during casting of the package components. When the waste package closure weld is made, the most severe thermal effects of the process are restricted to the nickel-carbon insert material which is far better able to accommodate them than is cast iron. Use of nickel-carbon weld inserts should eliminate any need for pre-weld and post-weld heat treatments which are a problem to apply to nuclear waste packages. Although the waste package closure weld approach described results in a dissimilar metal combination, the relative surface area of nickel-to-iron, their electrochemical relationship, and the presence of graphite in both materials will act to prevent any galvanic corrosion problem.

3 Claims, 2 Drawing Figures

SEAL WELDED CAST IRON NUCLEAR WASTE CONTAINER

GOVERNMENT CONTRACT

This invention was made or conceived during the performance of work under Government Contract No. EY-76-C-06-1830 (Subcontract E-512-6400) with the Department of Energy.

This application is a continuation of application Ser. No. 061,569,070, filed Jan. 9, 1986, now abandoned.

The present invention pertains to cast iron nuclear waste containers which are hermetically sealed by welding. It is especially concerned with those heavy walled, waste containers made from gray cast irons or ductile cast irons.

It is desired that nuclear waste containers, to be geologically isolated, be designed to provide years of hermetic containment. Consequently, any design for such containers must address the problem of corrosion by geological fluids, as well as closure welding related failure concerns due to residual stresses in the weld metal and heat affected zones surrounding the fusion zone of the weld.

A previously proposed concept for a waste container consisted of a heavy walled main body component casint of gray or ductile cast iron having a test tube like shape. The wall thickness of such containers in designs providing substantial radiation shielding of high-level waste can exceed 12 inches. After loading the nuclear waste material into the container casting the open end of the casting is hermetically sealed by welding a cast iron cylindrical plug into this opening. The plug has a depth on the order of the wall thickness of the container. The closure weld thus formed is tubular in shape, extending down around the circumference of the plug for a distance on the order of the wall thickness of the main body component.

The phase structure of commercial gray and ductile iron castings typically consists of ferrite and graphite at ambient temperature, but during welding the austenite phase will form in that region of the heat-affected zone nearest the fusion line. It is well known that is austenite is not slowly cooled it can transform into the strong non-equilibrium phase called martensite. Martensite is generally to be avoided in welded material since a volume increase accompanies it resulting in tensile stress in the adjacent material. This martensite related stress is likely to cause cracking in low ductility materials such as cast irons. As a very general rule, martensite formation can be prevented in steel weldments without the necessity of reducing their cooling rate by preheating, if the materials's carbon equivalent (C.E.) does not exceed 0.45 (C.E. = % C + % Mn/6 + % Cr/5 + % Mo/4, Metals Handbook, 1971). This carbon equivalent limit is greatly exceeded by gray and ductile irons whose carbon level alone ranges typically between 3 and 4 w/o. Another major element typically found in these cast irons is silicon. Silicon is typically added in concentrations of about 2–3 weight percent to stabilize graphite phase rather than iron carbide (cementite) phase when these alloys are slowly cooled from the austenite phase. One of the characteristics of gray and ductile irons making them particularly suited to fabrication by casting results from formation of graphite during slow cooling which, due to its low density compared to iron, compensates for much of the shrinkage accompanying solidification. However, when these irons are not slowly cooled, the higher density iron carbide phase forms instead of graphite and the resulting solidification shrinkage is correspondingly higher. Consequently, iron carbide commonly forms in cast iron weldments cooled by adjacent metal, requiring the associated shrinkage and resulting tensile stress to be accommodated in the weld bead and surrounding structure. Cast irons have a low capacity for plastically accommodating tensile stress without fracturing.

The development of tensile stress due to severe weld restraint and solid and liquid phase transformation strains in materials having marginal ductility suggests that closure weld failure may occur on cast iron self-shielded packages unless precautions are taken to reduce the severity of the condition. This is normally accomplished in welding practice by using more compliant weld joint designs, elevating the temperature of the parts to reduce the rate of postweld cooling (preheating), and annealing after welding (postweld heat treatment). It is questionable whether effective preweld or postweld heat treatments can be applied to heavy-wall cast iron nuclear waste packages because of practical limitations imposed by their size, weight and temperature sensitive contents.

In response to these problems, the present inventors propose that the plug and main body components of cast iron nuclear waste packages be produced with nickel-carbon alloy welding inserts at the location to be closure welded. These nickel-carbon alloy inserts would be metallurgically bonded to the cast iron plug and cast iron main body component and then welded to each other, thereby forming the hermetic seal around the radioactive contents to be stored. The fusion zone and the heat affected zone of this weld are contained substantially within the confines of the nickel carbon inserts, thereby preventing any adverse metallurgical effects in either the cast iron plug or cast iron main body component.

Also in accordance with the present invention, the composition of the nickel-carbon alloy inserts has been selected such that their microstructures are characterized by islands of graphite phase in a matrix of nickel. The volume percentage of graphite phase in the nickel carbon inserts is selected so as to minimize any galvanic corrosion between the nickel-carbon inserts and the cast iron members they are bonded to.

These and other aspects of the present invention will become more apparent upon review of the drawings in conjunction with the detailed description of the invention which follows.

p DESCRIPTION OF THE PREFERRED EMBODIMENTS

Figure 1:
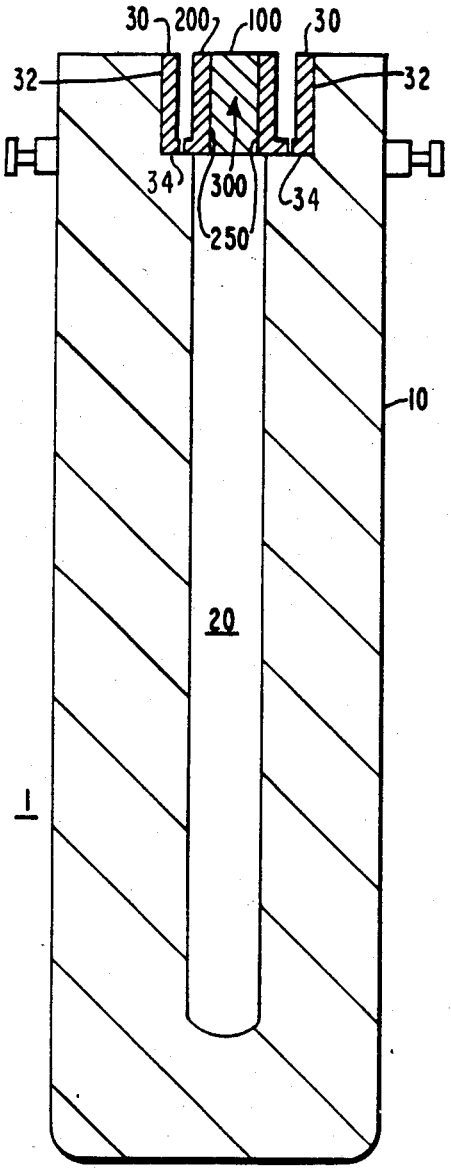
FIG. 1 shows a longitudinal cross section of a main body component and a plug component in accordance with the present invention.

FIG. 1 shows a cylindrical heavy-wall nuclear waste container 1 composed of two unassembled components: a main body component 10 and a plug component 100. Both components are mainly composed of cast iron, preferably grey or ductile cast iron, with sufficient wall thickness to provide the containment function with respect to any radioactive material to be held in cavity 20 of the main body component 10. At the opening to the cavity 20 a nickel carbon alloy insert or component 30 has been metallurgically bonded to the cast iron main body component 10. The bond interface is schematically shown at 32 and 34.

Similarly, a nickel-carbon alloy insert or component 200 has been metallurgically bonded to the circumferential periphery of the cast iron portion 300 of plug 100 forming a bond line interface 250. As a possible alternative, the plug could be comprised entirely of the Ni-C alloy.

An insert-to-iron bonding method resulting in some fusion of the materials at their interfaces 32, 34 and 250, is selected to assure that all mechanical interfaces are hermetically sealed by metallurgical bonds. For example, the nickel-carbon inserts 30 and 200 may be bonded to their respective components during the casting of the component by having the inserts preplaced in the casting mold. Alternatively, for example, the inserts could be applied to the components as a thick weld overlay. In any case, any adverse microstructural or stress conditions produced in the insert-to-case iron bond region can be modified by controlling thermal conditions during the bonding operation or by subsequent heat treatment, prior to loading the main body component with nuclear waste material.

Figure 2:
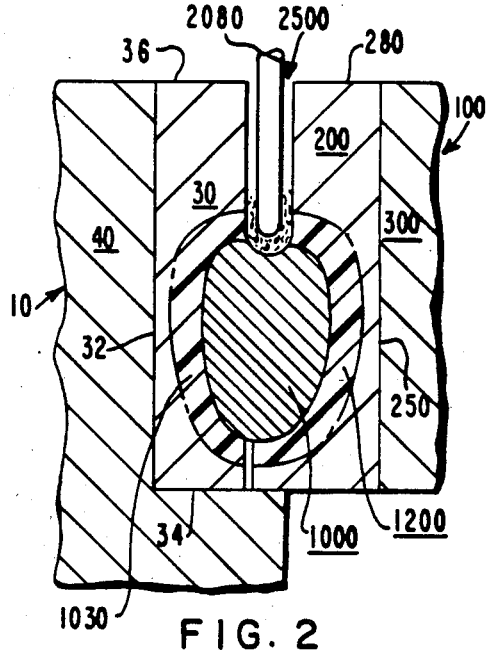
FIG. 2 shows an enlarged partial cross section in the region of the nickel-carbon inserts during welding.

Once the radioactive materials have been placed in cavity 20, the plug 100 is placed in the opening to the cavity as shown in FIG. 1. Now referring to FIG. 2, it will be noted that closure of the assembled components involves joining the plug 100 and main body components 10 by welding the nickel carbon inserts 200 and 30 together using a suitable autogenousor filler metal welding process. A narrow groove, arc, filler metal welding process is illustrated in FIG. 2. By using a sufficient amount of insert material and controlling the welding process, the cast iron can be prevented from melting or reaching temperatures where austenite if formed ($T < T$ eutectoid). This prevents the high stress producing solidification or martensite phase changes from occurring. Furthermore, the cast iron remains a stronger material since it is not subjected to severe elevated temperatures and, thus, is better able to react to those thermal and solidification strains transmitted from the insert welding operation without fracturing. These conditions are illustrated in FIG. 2. It can be seen that the nickel-carbon inserts 30 and 200 have sufficient thickness to fully contain, not only the fusion zone 100 of the weld, but also the heat affected zones 1030 and 1200. It can thus be seen that the cast iron 40 and 300 adjacent to the nickel-carbon alloy inserts 30 and 200, respectively, it thus kept below its austenizing temperature during welding.

FIG. 2 shows the in-progress forming of the closure weld using a consumable welding electrode or filler wire 2080 to fill the narrow tubular groove 2500 formed between inserts 30 and 200. At the completion of closure welding, groove 2500 will be completely filled with weld metal and fusion zone 1000 and heat affected zones 1030 and 1200 will extend to the top surfaces 36 and 280 of nickel carbon inserts 30 and 200, respectively.

The weld rod 2080 may be selected from commercially available nickel-carbon, and nickel-carbon-iron alloy metal arc welding rods, and flux core wire. For example, NI-ROD, NI-ROD 55, NI-ROD FC55 (all manufactured and marketed by Huntington Alloys of Huntington, W. Va.) are suitable for use in the present invention. NI-ROD, a nickel-carbon welding electrode, has a nominal composition of (wt. %): 95 Ni, 1.0 C, 0.2 Mn, 3.0 Fe, 0.005 S, 0.7 Si, and 0.1 Cu. NI-ROD is a preferred welding rod for use herein.

While other welding processes are contemplated, the joint design shown in the figures may require modification, since the closure welding process, joint design, and insert material thickness have to be developed together to insure that temperature and stress conditions produced in the surrounding cast iron fall below critical levels which can cause structural damage.

The nickel-carbon inserts have a composition of about 2 to 5 weight percent carbon with the remainder of the alloy being nickel except for minor amounts of incidental impurities normally observed in commercially pure nickel (i.e. Nickel 200). In this composition range the inserts, which may be produced by casting, have a microstructure which is characterized by about 8–20 volume percent of graphite, the actual volume percentage observed depends upon the carbon content of the alloy selected. The graphite is distributed in substantially isolated, or discontinuous, islands in a matrix structure which is essentially nickel containing small amounts of carbon in solution, in addition to any incidental impurities.

While not wishing to be bound by theory, the applicants believe that the understanding of, use of, and the advantageous results obtained from, the present invention can be furthered by the following theories upon which they have based the present invention:

The nickel-carbon binary, equilibrium phase diagram is eutectic in nature. Nickel does not undergo any solid state phase transformations. There are no stable nickel carbides. The two elements interact to produce a simple eutectic system where the solid phases stable below about 2404° F. (1318° C.) for compositions exceeding about 0.55 weight percent carbon are nickel (containing small amounts of carbon in solid solution) and graphite. While there have been some reports that a carbide may form in the nickel-carbon system during rapid solidification, it has also been noted that this phase decomposes to the stable nickel and graphite phases at temperatures above about 300° C. Thus, unlike cast iron, the heat affected zone adjacent to a weldment in nickel-carbon alloys will not undergo stress-producing solid state phase transformations. Since carbides are not readily formed in the nickel-carbon system but, instead, graphite is produced, weldment shrinkage and associated stresses will be minimized. The thermal coefficients of expansion of nickel and iron are also similar, thus, closure welding will minimize stresses due to any expansion mismatch.

Although stress related to thermal and shrinkage effects would be greatly reduced by using a nickel-carbon welding insert, they cannot be totally eliminated and, therefore some accommodation must occur within the cast iron structure. However, with proper attention given to interrelated closure design and welding considerations it is possible to accommodate much of the stress by plastic deformation of the insert material. The low solubility of carbon in nickel and its presence as a weak graphite constituent in alloys where this solubility limit is exceeded, implies that nickel-carbon alloys should exhibit mechanical properties similar to that of commercially pure nickel if prepared with a discontinuous graphite microstructure. It is therefore believed that our nickel-carbon alloys can provide a large capacity to plastically accommodate weld induced strains without high stresses being developed.

As already noted, nuclear waste packages manufactured for geologic isolation should be designed to provide years of hermetic containment. Consequently, corrosion by geologic fluids as well as welding related considerations have to be addressed in any proposal involving use of dissimilar metals in waste package construction. The principal concern is that a galvanic corrosion condition may result whereby one of the metals will be attacked at an accelerated rate.

It our invention, it is believed that the nickel-carbon alloy forming the insert will be more noble than the cast iron it is bonded to. It is therefore believed that the cast iron will form the active material if coupled to nickel; i.e., the case iron structure surrounding the nickel-rich closure welded insert on a nuclear waste package would selectively corrode galvanically in the presence of an electrolyte. This seemingly negative dissimilar metal condition would be partially nullified, however, by the low surface area ratio of the relatively noble nickel-rich insert to active cast iron.

The precise relationship governing the degree to which corrosion of the active leg of a couple will be galvanically accelerated is quite dependent upon specific electrochemical details of the corrosion system; presence or absence of oxygen, polarization, pH, for example. However, in all instances, the increase in corrosion rate of the active leg over that measured in the uncoupled condition would be proportional to the area ratio of the noble-to-active materials.

Any concern over galvanic corrosion in the present invention is further reduced by considering the influence of the graphite phase in the nickel-carbon insert and cast iron materials. Graphite is a more noble material then either nickel or steel. Thus, the metallic portions of the cast iron and nickel-carbon weld insert should corrode preferantially to the particles of graphite contained within these materials.

It is therefore our belief that in the cast iron nuclear waste package sealed by closure welding a nickel-carbon insert, the more active cast iron leg of the galvanic couple would begin to corrode initially. This will involve corrosion of some of the metallic portion of the cast iron at the surface of the package uncovering particles of the contained more noble graphite constituent. As graphite is exposed, it will shift the cast iron potential in the noble direction, reducing the galvanic potential difference between it and the nickel-carbon insert. Should this graphite exposure result in the cast iron becoming more noble than the nickel-carbon insert causing corrosion of the nickel-carbon insert to become galvanically accelerated, such corrosion will also uncover particles of graphite. It follows that after some cast iron and nickel-carbon corrosion has occurred, the electrochemical potential of these materials will be controlled by graphite released in the process, and galvanic corrosion will cease to be an accelerating mechanism.

Typical cast irons contain about 3 to 4 weight percent (or about 11 to 15 volume percent) graphite, thus, similar composition nickel-carbon alloys are considered for the closure welding insert application.

In summary, in the present invention, nickel-carbon alloys are used as bonded welding inserts to circumvent certain fundamental problems associated with direct welding of cast iron nuclear waste packages. A summary of the advantageous attributes of the container design and insert material are given below:

1. By using a welding insert, the cast iron is removed from the vicinity of closure welding thereby preventing its failure by thermally induced phase transformation related stress effects. This eliminates the need to apply very high temperature pre-weld and post-weld heat treatments commonly given high carbon iron-base materials to prevent weldment failure.

2. The absence of allotropy and carbide formation in the recommended nickel-carbon welding insert material, comparable thermal expansion coefficient to that of iron, and low strength and high ductility will combine to minimize the level of welding stress which must be accommodated by the overall structure. This should eliminate any need for pre-weld or post-weld heat treatment.

3. The external surface area ration of welding insert material to cast iron, and the electrochemical relationship between nickel, iron and graphite will combine to nullify any potential for galvanic corrosion.

Other embodiments of the invention will become more apparent to those skilled in the art from a consideration of the specification or practice of the invention disclosed herein. It is intended that the specificiation and examples be considered as exemplary only, with the true scope and spirit of the invention being indicated by the following claims.

We claim:

1. An article of manufacture comprising a cast iron container having an opening at one end and a cast iron plug;

a first nickel-carbon alloy fusion weldable insert surrounding said opening and metallurgically bonded to said cast iron container at said one end of said container; a second nickel-carbon alloy insert metallurgically bonded to said cast iron plug located within said opening and surrounded by the first insert said inserts being jointed by a fusion bond in said opening without heating said cast iron container to an austenite formation temperature thereby sealing the interior of the container from the exterior ambient outside said opening; said nickel-carbon alloy containing about 2 to 5 w% carbon; and both said nickel-carbon alloy insert and said cast iron container have a microstructure containing a graphite phase.

2. The article of manufacture according to claim 1 wherein the volume percent of graphite in said first insert and the volume percent of graphite in said cast iron container are selected to minimize galvanic corrosion between said nickel carbon alloy first insert and said cast iron container.

3. The article according to claim 1 wherein said nickel-carbon alloy forming said first insert consists essentially of about 2 to 5 w% carbon with the remainder being essentially nickel.

* * * * *